US005855173A

United States Patent [19]

Chatterjee et al.

[11] Patent Number: 5,855,173

[45] **Date of Patent: *Jan. 5, 1999**

[54] ZIRCONIA ALLOY CYLINDERS AND SLEEVES FOR IMAGING AND LITHOGRAPHIC PRINTING METHODS

[75] Inventors: Dilip K. Chatterjee; Syamal K. Ghosh; Barbara L. Nüssel, all of Rochester, N.Y.

[73] Assignee: Eastman Kodak Company, Rochester, N.Y.

[ * ] Notice: The term of this patent shall not extend beyond the expiration date of Pat. No. 5,743,188.

[21] Appl. No.: 844,348

[22] Filed: Apr. 18, 1997

Related U.S. Application Data

[63] Continuation-in-part of Ser. No. 576,178, Dec. 21, 1995, Pat. No. 5,743,188.

[51] Int. Cl.[6] ..... B41C 1/10

[52] U.S. Cl. ..... 101/453; 101/456; 101/467; 101/478

[58] Field of Search ..... 101/450.1, 451, 101/453, 454, 458, 459, 456, 467, 478, 465, 466, 463.1; 430/302, 945

[56] References Cited

U.S. PATENT DOCUMENTS

| | | | |
|---|---|---|---|
| 3,506,779 | 4/1970 | Brown et al. | 101/467 |
| 3,549,733 | 12/1970 | Caddell | 101/401.1 |
| 3,574,657 | 4/1971 | Burnett | 101/465 |
| 3,654,864 | 4/1972 | Ovshinsky | 101/467 |
| 3,793,033 | 2/1974 | Mukherjee | 101/456 |
| 3,832,948 | 9/1974 | Barker | 101/453 |
| 3,945,318 | 3/1976 | Landsman | 101/467 |
| 3,962,513 | 6/1976 | Eames | 101/463.1 |
| 3,964,389 | 6/1976 | Peterson | 101/467 |
| 4,034,183 | 7/1977 | Uhlig | 219/121.85 |
| 4,054,094 | 10/1977 | Caddell | 101/467 |
| 4,081,572 | 3/1978 | Pacansky | 101/467 |
| 4,334,006 | 6/1982 | Kitajima | 430/254 |
| 4,687,729 | 8/1987 | Cadwell et al. | 101/463.1 |
| 4,693,958 | 9/1987 | Schwartz | 430/302 |
| 4,703,024 | 10/1987 | Aronov | 501/103 |
| 4,731,317 | 3/1988 | Fromson | 430/159 |
| 4,769,310 | 9/1988 | Gugger et al. | 430/346 |
| 4,794,680 | 1/1989 | Meyerhoff et al. | 492/54 |
| 4,846,065 | 7/1989 | Mayrhofer et al. | 101/453 |
| 4,967,663 | 11/1990 | Metcalf | 101/348 |
| 5,045,697 | 9/1991 | Schneider | 347/224 |
| 5,238,778 | 8/1993 | Hirai | 101/467 |
| 5,272,120 | 12/1993 | Kosuda et al. | 501/105 |
| 5,290,332 | 3/1994 | Chatterjee et al. | 65/18.1 |
| 5,293,817 | 3/1994 | Nussel et al. | 101/453 |
| 5,317,970 | 6/1994 | Nussel et al. | 101/478 |
| 5,336,282 | 8/1994 | Ghosh et al. | 51/309 |
| 5,345,869 | 9/1994 | Treverton et al. | 101/454 |

(List continued on next page.)

FOREIGN PATENT DOCUMENTS

| | | |
|---|---|---|
| 0 001 068 | 3/1979 | European Pat. Off. . |
| 0 531 878 A1 | 3/1993 | European Pat. Off. . |
| 0 573 091 | 12/1993 | European Pat. Off. . |
| 693 371 | 1/1996 | European Pat. Off. . |
| 44 42 235 A1 | 6/1995 | Germany . |

*Primary Examiner*—Stephen R. Funk
*Attorney, Agent, or Firm*—J. Lanny Tucker

[57] ABSTRACT

Rotary lithographic printing members are prepared from a non-porous zirconia ceramic that is an alloy of $ZrO_2$ and a second oxide chosen from MgO, CaO, $Y_2O_3$, $Sc_2O_3$, a rare earth oxide or a combination of any of these. These printing members can be rotary printing cylinders having a zirconia alloy ceramic printing surface. Such cylinders can be composed of zirconia alloy ceramic throughout, or have a ceramic sleeve or shell mounted around a non-ceramic core. In use, the surface of the zirconia alloy ceramic printing member is imagewise exposed to infrared radiation which transforms it from a hydrophilic to an oleophilic state or from an oleophilic to a hydrophilic state, thereby creating a lithographic printing surface which is hydrophilic in non-image areas and is oleophilic and thus capable of accepting printing ink in image areas. These printing members are directly laser-imageable as well as image erasable.

17 Claims, 1 Drawing Sheet

U.S. PATENT DOCUMENTS

| | | | |
|---|---|---|---|
| 5,353,705 | 10/1994 | Lewis | 101/453 |
| 5,358,913 | 10/1994 | Chatterjee et al. | 501/103 |
| 5,385,092 | 1/1995 | Lewis | 101/467 |
| 5,395,729 | 3/1995 | Reardon | 430/200 |
| 5,440,987 | 8/1995 | Williams et al. | 101/467 |
| 5,454,318 | 10/1995 | Hirt et al. | 101/453 |
| 5,543,269 | 8/1996 | Chatterjee et al. | 430/346 |
| 5,555,809 | 9/1996 | Hirt et al. | 101/451 |
| 5,713,287 | 2/1998 | Gelbart | 101/478 |
| 5,743,188 | 4/1998 | Ghosh et al. | 101/467 |

FIG. 1
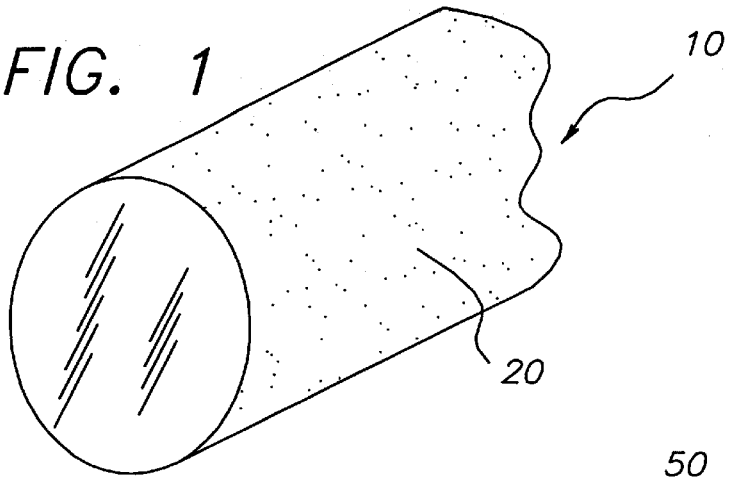
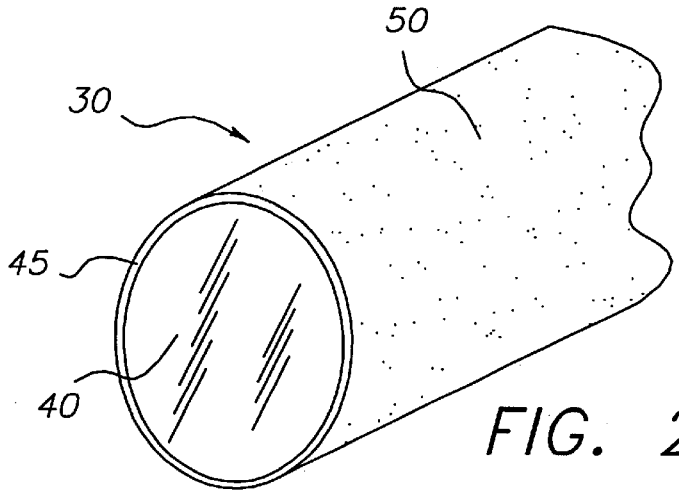
FIG. 2
FIG. 3
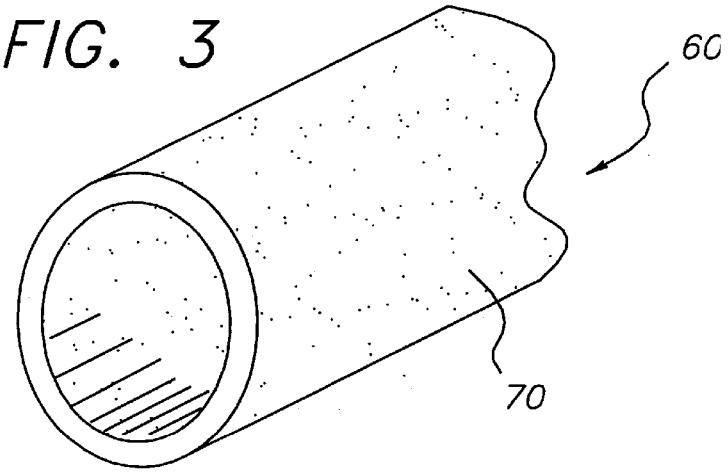

ZIRCONIA ALLOY CYLINDERS AND SLEEVES FOR IMAGING AND LITHOGRAPHIC PRINTING METHODS

CROSS-REFERENCE TO RELATED APPLICATIONS

This application is a CIP of U.S. Ser. No. 08/576,178, filed Dec. 21, 1995, now U.S. Pat. No. 5,743,188 which is based on provisional application 60/005729, filed Oct. 20, 1995.

FIELD OF THE INVENTION

This invention relates in general to lithography and in particular to new and improved lithographic printing members. More specifically, this invention relates to novel printing cylinders and sleeves made of zirconia alloys that are readily imaged and then used for lithographic printing.

BACKGROUND OF THE INVENTION

The art of lithographic printing is based upon the immiscibility of oil and water, wherein the oily material or ink is preferentially retained by the image area and the water or fountain solution is preferentially retained by the non-image area. When a suitably prepared surface is moistened with water and an ink is then applied, the background or non-image area retains the water and repels the ink while the image area accepts the ink and repels the water. The ink on the image area is then transferred to the surface of a material upon which the image is to be reproduced, such as paper, cloth and the like. Commonly the ink is transferred to an intermediate material called the blanket, which in turn transfers the ink to the surface of the material upon which the image is to be reproduced.

Aluminum has been used for many years as a support for lithographic printing plates. In order to prepare the aluminum for such use, it is typical to subject it to both a graining process and a subsequent anodizing process. The graining process serves to improve the adhesion of the subsequently applied radiation-sensitive coating and to enhance the water-receptive characteristics of the background areas of the printing plate. The graining affects both the performance and the durability of the printing plate, and the quality of the graining is a critical factor determining the overall quality of the printing plate. A fine, uniform grain that is free of pits is essential to provide the highest quality performance.

Both mechanical and electrolytic graining processes are well known and widely used in the manufacture of lithographic printing plates. Optimum results are usually achieved through the use of electrolytic graining, which is also referred to in the art as electrochemical graining or electrochemical roughening, and there have been a great many different processes of electrolytic graining proposed for use in lithographic printing plate manufacturing. Processes of electrolytic graining are described, for example, in U.S. Pat. No. 3,755,116, U.S. Pat. No. 3,887,447, U.S. Pat. No. 3,935,080, U.S. Pat. No. 4,087,341, U.S. Pat. No. 4,201,836, U.S. Pat. No. 4,272,342, U.S. Pat. No. 4,294,672, U.S. Pat. No. 4,301,229, U.S. Pat. No. 4,396,468, U.S. Pat. No. 4,427,500, U.S. Pat. No. 4,468,295, U.S. Pat. No. 4,476,006, U.S. Pat. No. 4,482,434, U.S. Pat. No. 4,545,875, U.S. Pat. No. 4,545,875, U.S. Pat. No. 4,548,683, U.S. Pat. No. 4,564,429, U.S. Pat. No. 4,581,996, U.S. Pat. No. 4,618,405, U.S. Pat. No. 4,735,696, U.S. Pat. No. 4,897,168 and U.S. Pat. No. 4,919,774.

In the manufacture of lithographic printing plates, the graining process is typically followed by an anodizing process, utilizing an acid such as sulfuric or phosphoric acid, and the anodizing process is typically followed by a process which renders the surface hydrophilic such as a process of thermal silication or electrosilication. The anodization step serves to provide an anodic oxide layer and is preferably controlled to create a layer of at least 0.3 $g/m^2$. Processes for anodizing aluminum to form an anodic oxide coating and then hydrophilizing the anodized surface by techniques such as silication are very well known in the art, and need not be further described herein.

Included among the many patents relating to processes for anodization of lithographic printing plates are U.S. Pat. No. 2,594,289, U.S. Pat. No. 2,703,781, U.S. Pat. No. 3,227,639, U.S. Pat. No. 3,511,661, U.S. Pat. No. 3,804,731, U.S. Pat. No. 3,915,811, U.S. Pat. No. 3,988,217, U.S. Pat. No. 4,022,670, U.S. Pat. No. 4,115,211, U.S. Pat. No. 4,229,266 and U.S. Pat. No. 4,647,346. Illustrative of the many materials useful in forming hydrophilic barrier layers are polyvinyl phosphonic acid, polyacrylic acid, polyacrylamide, silicates, zirconates and titanates. Included among the many patents relating to hydrophilic barrier layers utilized in lithographic printing plates are U.S. Pat. No. 2,714,066, U.S. Pat. No. 3,181,461, U.S. Pat. No. 3,220,832, U.S. Pat. No. 3,265,504, U.S. Pat. No. 3,276,868, U.S. Pat. No. 3,549,365, U.S. Pat. No. 4,090,880, U.S. Pat. No. 4,153,461, U.S. Pat. No. 4,376,914, U.S. Pat. No. 4,383,987, U.S. Pat. No. 4,399,021, U.S. Pat. No. 4,427,765, U.S. Pat. No. 4,427,766, U.S. Pat. No. 4,448,647, U.S. Pat. No. 4,452,674, U.S. Pat. No. 4,458,005, U.S. Pat. No. 4,492,616, U.S. Pat. No. 4,578,156, U.S. Pat. No. 4,689,272, U.S. Pat. No. 4,935,332 and EP-A 0 190 643.

The result of subjecting aluminum to an anodization process is to form an oxide layer which is porous. Pore size can vary widely, depending on the conditions used in the anodization process, but is typically in the range of from about 0.1 to about 10 $\mu$m. The use of a hydrophilic barrier layer is optional but preferred. Whether or not a barrier layer is employed, the aluminum support is characterized by having a porous wear-resistant hydrophilic surface which specifically adapts it for use in lithographic printing, particularly in situations where long press runs are required.

A wide variety of radiation-sensitive materials suitable for forming images for use in the lithographic printing process are known. Any radiation-sensitive layer is suitable which, after exposure and any necessary developing and/or fixing, provides an area in imagewise distribution which can be used for printing.

Useful negative-working compositions include those containing diazo resins, photocrosslinkable polymers and photopolymerizable compositions. Useful positive-working compositions include aromatic diazooxide compounds such as benzoquinone diazides and naphthoquinone diazides.

Lithographic printing plates of the type described hereinabove are usually developed with a developing solution after being imagewise exposed. The developing solution, which is used to remove the non-image areas of the imaging layer and thereby reveal the underlying porous hydrophilic support, is typically an aqueous alkaline solution and frequently includes a substantial amount of organic solvent. The need to use and dispose of substantial quantities of alkaline developing solution has long been a matter of considerable concern in the printing art.

Efforts have been made for many years to manufacture a printing plate which does not require development with an alkaline developing solution. Examples of the many patents and published patent applications relating to such prior efforts include: U.S. Pat. No. 3,506,779 (Brown et al), U.S. Pat. No. 3,549,733 (Caddell), U.S. Pat. No. 3,574,657 (Burnett), U.S. Pat. No. 3,793,033 (Mukherjee), U.S. Pat. No. 3,832,948 (Barker), U.S. Pat. No. 3,945,318 (Landsman), U.S. Pat. No. 3,962,513 (Eames), U.S. Pat. No. 3,964,389 (Peterson), U.S. Pat. No. 4,034,183 (Uhlig), U.S. Pat. No. 4,054,094 (Caddell et al), U.S. Pat. No. 4,081,572 (Pacansky), U.S. Pat. No. 4,334,006 (Kitajima et al), U.S. Pat. No. 4,693,958 (Schwartz et al), U.S. Pat. No. 4,731,317 (Fromson et al), U.S. Pat. No. 5,238,778 (Hirai et al), U.S. Pat. No. 5,353,705 (Lewis et al), U.S. Pat. No. 5,385,092 (Lewis et al), U.S. Pat. No. 5,395,729 (Reardon et al), EP-A-0 001 068, EP-A-0 573 091.

Lithographic printing plates designed to eliminate the need for a developing solution which have been proposed heretofore have suffered from one or more disadvantages which have limited their usefulness. For example, they have lacked a sufficient degree of discrimination between oleophilic image areas and hydrophilic non-image areas with the result that image quality on printing is poor, or they have had oleophilic image areas which are not sufficiently durable to permit long printing runs, or they have had hydrophilic non-image areas that are easily scratched and worn, or they have been unduly complex and costly by virtue of the need to coat multiple layers on the support.

The lithographic printing plates described hereinabove are printing plates which are employed in a process which employs both a printing ink and an aqueous fountain solution. Also well known in the lithographic printing art are so-called "waterless" printing plates which do not require the use of a fountain solution. Such plates have a lithographic printing surface comprised of oleophilic (ink-accepting) image areas and oleophobic (ink-repellent) background areas. They are typically comprised of a support, such as aluminum, a photosensitive layer which overlies the support, and an oleophilic silicone rubber layer which overlies the photosensitive layer, and are subjected to the steps of imagewise exposure (usually in the infrared region) followed by development to form the lithographic printing surface.

It is also known to use various non-planar surfaces for lithographic printing. For example, instead of mounting a flat plate around a printing press cylinder, the cylinder itself can be made of a suitable material for printing. Alternatively, a printing "sleeve" having a printing surface can be fitted around a metal core. Printing cylinders and sleeves having a porous ceramic printing surface are described, for example in U.S. Pat. No. 5,293,817 (Nüssel et al). These porous ceramic materials provide an interconnected network that carries dampening fluid from the inside of the cylinder to the printing surface.

U.S. Pat. No. 5,317,970 (Nüssel et al), U.S. Pat. No. 5,454,318 (Hirt et al), U.S. Pat. No. 5,555,809 (Hirt et al) and EP-A-0 693 371 (Nüssel et al), all disclose various ceramic printing cylinders and sleeves for wet lithography, whereby an oleophilic material is imagewise deposited on the printing members to provide ink accepting image areas.

While such materials have advantages in certain instances, there is a need for printing cylinders and/or sleeves that have high density mechanical strength (that is, they have greater fracture toughness) and do not require the use of deposited oleophilic materials as in the art in the preceding paragraph. Moreover, there is a need for greater image quality than is achievable with porous ceramic surfaces.

SUMMARY OF THE INVENTION

In accordance with this invention, there is provided a rotary lithographic printing member that can be imaged directly using a laser and is image erasable, the printing member having a printing surface composed of a non-porous zirconia ceramic that is an alloy of $ZrO_2$ and a secondary oxide selected from the group consisting of MgO, CaO, $Y_2O_3$, $Sc_2O_3$, a rare earth oxide, and combinations thereof, the zirconia alloy ceramic having a density of from about 5.6 to about 6.2 g/cm$^3$.

This invention also provides a rotary lithographic printing member having an imaged printing surface adapted for use in lithographic printing, the imaged printing surface comprising the non-porous zirconia alloy ceramic as described above, and having thereon an imagewise distribution of hydrophilic areas and oleophilic areas.

Further, this invention provides a method of imaging comprising the steps of:

A) providing a rotary lithographic printing member as described above, and

B) providing an image on the printing member by imagewise exposing the printing surface to electromagnetic radiation that transforms the printing surface from a hydrophilic to an oleophilic state, or from an oleophilic to a hydrophilic state, thereby creating a lithographic printing surface having both image areas and non-image areas.

This method can be carried further as a printing method by additionally:

C) contacting the lithographic printing surface with an aqueous fountain solution and a lithographic printing ink, thereby forming an inked lithographic printing surface, and D) contacting the inked lithographic printing surface with a substrate to thereby transfer the printing ink to the substrate, forming an image thereon.

Still again, this method can also include subsequent steps of cleaning off the printing inks from the printing surface, erasing the image on the printing surface (as described below), and reusing (that is, re-imaging) the printing member.

The rotary printing member of this invention has a number of advantages. Thus, for example, no chemical processing is required so that the effort, expense and environmental concerns associated with the use of aqueous alkaline developing solutions are avoided. Post-exposure baking or blanket exposure to ultraviolet or visible light sources, as are commonly employed with many lithographic printing plates, are not required. Imagewise exposure of the printing member can be carried out with a focused laser beam which converts the ceramic surface from a hydrophilic to an oleophilic state or from an oleophilic to a hydrophilic state. Exposure with a laser beam enables the printing member to be imaged directly using digital data without the need for intermediate films and conventional time-consuming optical imaging methods. Since no chemical processing, wiping, brushing, baking or treatment of any kind is required, it is feasible to expose the printing member directly on the printing press by equipping the press with a laser exposing device and suitable means for controlling the position of the laser exposing device. A still further advantage is that the printing member is well adapted to function with conventional fountain solutions and conventional lithographic printing inks so that no novel or costly chemical compositions are required.

The printing member of this invention is generally a printing cylinder that is adapted to be mounted on a lithographic printing press. The cylinder can be made partially or totally of the zirconia alloy ceramic, and preferably, it can be composed of a non-ceramic metal core having a zirconia alloy ceramic sleeve fitted over the core, as illustrated in one or more of the drawings described below. The zirconia alloy ceramic is non-porous (as defined below) because, unlike the printing cylinders described in U.S. Pat. No. 5,293,817 (noted above), there is no need for a dampening fluid to be moved from within the cylinder to its surface. Moreover, the higher density of the non-porous ceramic provides improved printing quality, and greater mechanical strength.

The zirconia alloy ceramic utilized in this invention has many characteristics which render it especially beneficial for use in lithographic printing. Thus, for example, the ceramic surface is extremely durable, abrasion-resistant, and long wearing. Lithographic printing members utilizing this surface are capable of producing a virtually unlimited number of copies, for example, press runs of up to several million. On the other hand, since very little effort is required to prepare the member for printing, it is also well suited for use in very short press runs. Discrimination between oleophilic image areas and hydrophilic non-image areas is excellent so that image quality on printing is unsurpassed. Its use is fast and easy to carry out, image resolution is very high and imaging is especially well suited to images that are electronically captured and digitally stored.

The lithographic printing members utilized in this invention exhibit exceptional long-wearing characteristics that greatly exceed those of the conventional grained and anodized aluminum printing members. Moreover, they are much simpler and less costly than conventional waterless printing members that are based on the use of silicone rubbers, while also providing for greater run lengths.

A further particular advantage of the lithographic printing member of this invention derives from the "gapless" nature of the ceramic rotary printing cylinder. Gapless cylinders enable the user to run a printing press faster, to have greater flexibility in format sizes of the printed product, and to waste less paper in the gap area of the press.

Another particular advantage of lithographic printing members prepared from non-porous zirconia alloy ceramics as described herein is that, unlike conventional lithographic printing members, they are erasable and reusable. Thus, for example, after the printing ink has been removed from the printing surface using known devices, the oleophilic image areas of the printing surface can be erased from the ceramic printing surface by thermally-activated oxidation or by laser-assisted oxidation. Accordingly, the printing member can be imaged, erased and re-imaged repeatedly.

Zirconia alloy ceramics are well-known, commercially available materials which have a multitude of uses. However, their use in improving the lithographic printing process has up to now only been disclosed in the field of dampening rollers. The use of zirconia alloy ceramics as directly laser-imageable, erasable printing members in "direct-to-press" applications has not been heretofore disclosed and represents a major advance in the lithographic printing art.

BRIEF DESCRIPTION OF THE DRAWINGS

FIG. 1 is a highly schematic fragmentary isometric view of a printing member of this invention that is composed entirely of non-porous zirconia alloy ceramic.

FIG. 2 is a highly schematic fragmentary isometric view of a printing member of this invention that is composed of a non-ceramic core and a non-porous zirconia alloy ceramic layer or sleeve.

FIG. 3 is a highly schematic fragmentary isometric view of a hollow, non-porous zirconia alloy ceramic printing sleeve of this invention.

DETAILED DESCRIPTION OF THE INVENTION

A zirconia alloy ceramic of stoichiometric composition is hydrophilic. Transforming it from a stoichiometric composition to a substoichiometric composition changes it from hydrophilic to oleophilic. Thus, in one embodiment of this invention, the lithographic printing member comprises a hydrophilic zirconia alloy ceramic of stoichiometric composition, and imagewise exposure (usually with infrared irradiation) converts it to an oleophilic substoichiometric composition in the exposed regions (image areas), leaving non-exposed (background) areas hydrophilic.

In an alternative embodiment of the invention, the lithographic printing member comprises an oleophilic zirconia alloy ceramic of substoichiometric composition, and imagewise exposure (usually with visible radiation) converts it to a hydrophilic stoichiometric composition in the exposed regions. In this instance, the exposed regions serve as the background (or non-image areas) and the unexposed regions serve as the image areas.

The hydrophilic zirconia alloy ceramic is a stoichiometric oxide, $ZrO_2$, while the oleophilic zirconia alloy ceramic is a substoichiometric oxide, $ZrO_{2-x}$. The change from a stoichiometric to a substoichiometric composition is achieved by reduction while the change from a substoichiometric composition to a stoichiometric composition is achieved by oxidation.

In a preferred embodiment of the invention, the rotary lithographic printing member is comprised of an alloy of zirconium oxide ($ZrO_2$) and a secondary oxide selected from the group consisting of MgO, CaO, $Y_2O_3$, $Sc_2O_3$, rare earth oxides (such as $Ce_2O_3$, $Nd_2O_3$ and $Pr_2O_3$), and combinations or mixtures of any of these secondary oxides. The secondary oxide can also be referred to as a dopant. The preferred dopant is $Y_2O_3$. Thus, a zirconia-yttria alloy ceramic is most preferred.

The molar ratio of secondary oxide (or dopant) to zirconium oxide preferably ranges from about 0.1:99.9 to about 25:75, and is more preferably from about 0.5:99.5 to about 5:95. The dopant is especially beneficial in promoting the transformation of the high temperature stable phase of zirconia oxide (particularly, the tetragonal phase) to the metastable state at room temperature. It also provides improved properties such as, for example, high strength, and enhanced fracture toughness. The alloys described above have superior resistance to wear, abrasion and corrosion.

The zirconia alloy ceramic utilized in this invention can be effectively converted from a hydrophilic to an oleophilic state by exposure to infrared radiation at a wavelength of about 1064 $\mu$m (or 1.064 $\mu$m). Radiation of this wavelength serves to convert a stoichiometric oxide that is strongly hydrophilic, to a substoichiometric oxide that is strongly oleophilic by promoting a reduction reaction. Nd:YAG lasers that emit at 1064 nm are especially preferred for this purpose.

Conversion from an oleophilic to a hydrophilic state can be effectively achieved by exposure to visible radiation such as that having a wavelength of 488 nm (or 0.488 $\mu$m). Radiation of this wavelength serves to convert the substoichiometric oleophilic oxide to the stoichiometric hydrophilic oxide by promoting an oxidation reaction. Argon lasers that emit at 488 nm are especially preferred for this purpose, but carbon dioxide lasers (10600 nm, or 10.6 $\mu$m) radiating in the infrared are also useful. In addition, heating the substoichiometric oxide at from about 150° to about 250° C. can also convert the oxide to a stoichiometric state.

In addition, the zirconia alloy ceramics useful in preparing the printing members of this invention have very little porosity, that is generally less than about 0.1%. The density of the ceramic is generally from about 5.6 to about 6.2 g/cm$^3$, and preferably from about 6.03 to about 6.06 g/cm$^3$ (for the preferred zirconia-yttria ceramic having 3 mol % yttria). Generally, the ceramics have an average grain size of from about 0.1 to about 0.6 $\mu$m, and preferably from about 0.2 to about 0.5 $\mu$m.

Thus, the rotary printing members of this invention have an outer printing surface composed of the noted zirconia alloy ceramic. This outer surface can be highly polished (as described below), or be textured using any conventional texturing method (chemical or mechanical). In addition, glass beads can be incorporated into the ceramic to provide a textured or "matted" printing surface.

The zirconia alloys referred to herein and methods for manufacturing zirconia ceramic articles having very high densities (identified above) using very fine (0.1 to 0.6 $\mu$m average grain size) zirconia alloy powders are described in U.S. Pat. No. 5,290,332 (Chatterjee et al), U.S. Pat. No. 5,336,282 (Ghosh et al) and U.S. Pat. No. 5,358,913 (Chatterjee et al), the disclosures of which are incorporated herein by reference. The basic steps of preparing the printing articles include powder preparation by alloying the zirconia oxide with one or more of the secondary oxides. These powders are then consolidated in the desired shape. The consolidation step can be one of the following, each followed by sintering: a) dry pressing of the powders in a mold, b) cold isostatic pressing followed by machining, or c) injection molding followed by debinding.

The resolution of laser written images on zirconia alloy ceramic surfaces depends not only on the size of the laser spot but on the density and grain size of the zirconia alloy ceramic. The zirconia ceramics alloy described in the noted patents are especially effective for use in lithographic printing because of their very high density and fine grain sizes.

The printing member of this invention can be produced by the use of conventional molding techniques (isostatic, dry pressing or injection molding) and then sintered at high temperatures, such as from about 1200° to about 1600° C. (preferably at about 1500° C.), for a short period of time, such as from 1 to 2 hours. Alternatively, a printing member can be produced by thermal spray coating or vapor deposition of a zirconia alloy on a suitable semirigid or rigid cylinder core, such as a metallic core. For use in this invention, the printing surface of the zirconia alloy ceramic can be thermally or mechanically polished or the zirconia alloy ceramic can be used in the "as sintered" or "as coated" form. Preferably, the printing surface is polished to an average roughness of less than about 0.1 $\mu$m.

The zirconia in the ceramic utilized in this invention can be of any crystalline form including the tetragonal, monoclinic and cubic forms, or mixtures of any two or more of such phases. The predominantly tetragonal form of zirconia is preferred because of its high fracture toughness. By predominantly is meant, 100% of the zirconia is of the tetragonal crystalline form. Conversion of one form of zirconia to another is well known in the art.

In one embodiment of this invention, the rotary printing member is a solid or monolithic printing cylinder composed partially or totally of the noted zirconia alloy ceramic. If partially composed of the ceramic, at least the outer printing surface is so composed. A representative example of such a printing cylinder of this invention is shown in FIG. 1. Solid rotary printing cylinder 10 is composed of a zirconia alloy ceramic throughout, and has outer printing surface 20.

Another embodiment, illustrated in FIG. 2, is rotary printing cylinder 30 having metal or alloy (non-ceramic) core 40 on which zirconia alloy ceramic layer or shell 45 has been disposed or coated in a suitable manner to provide outer printing surface 50 composed of the zirconia alloy ceramic. Alternatively, the zirconia alloy ceramic layer or shell 45 can be a hollow, cylindrical printing sleeve or jacket (see FIG. 3) that is fitted around metal or alloy (non-ceramic) core 40. The cores of such printing members are generally composed of one or more metals, such as ferrous metals (iron or steel), nickel, brass, copper or magnesium, or alloys thereof. Steel cores are preferred. The metal cores can be hollow or solid throughout, or be comprised of more than one type of metal. The zirconia alloy ceramic layers disposed on the noted cores generally have a uniform thickness of from about 1 to about 10 mm.

Still another embodiment of this invention is shown in FIG. 3 wherein hollow cylindrical zirconia alloy ceramic sleeve 60 is composed entirely of the ceramic and has outer printing surface 70. Such sleeves can have a thickness within a wide range, but for most practical purposes, the thickness is from about 1 to about 10 cm.

The lithographic printing members of this invention can be imaged by any suitable technique on any suitable equipment, such as a plate setter or printing press. The essential requirement is imagewise exposure to electromagnetic radiation which is effective to convert the hydrophilic zirconia alloy ceramic to an oleophilic state or to convert the oleophilic zirconia alloy ceramic to a hydrophilic state. Thus, the members can be imaged by exposure through a transparency or can be exposed from digital information such as by the use of a laser beam. Preferably, the printing members are directly laser written. The laser, equipped with a suitable control system, can be used to "write the image" or to "write the background."

Zirconia alloy ceramics of stoichiometric composition are produced when sintering is carried out in air or an oxygen atmosphere. Zirconia alloy ceramics of substoichiometric composition are produced when sintering is carried out in an inert or reducing atmosphere.

Although zirconia alloy ceramics of any crystallographic form or mixtures of the several crystallographic forms can be used as printing cylinders and sleeves, the preferred zirconia alloy ceramic for use in this invention is an alloy of zirconium oxide ($ZrO_2$) and yttrium oxide ($Y_2O_3$) of stoichiometric composition having a molar ratio of yttria to zirconia of from about 0.5:99.5 to about 5.0:95.0. Such alloys are off-white in color and strongly hydrophilic. The action of the laser beam transforms the off-white hydrophilic zirconia alloy ceramic to black substoichiometric zirconia alloy ceramic which is strongly oleophilic. The off-white and black compositions exhibit different surface energies, thus enabling one region to be hydrophilic and the other oleophilic. The imaging of the printing surface is due to photo-assisted reduction while image erasure is due to thermally-assisted reoxidation.

For imaging the zirconia alloy ceramic printing surface, it is preferred to utilize a high-intensity laser beam with a power density at the printing surface of from about $30\times10^6$ W/cm$^2$ to about $850\times10^6$ W/cm$^2$ and more preferably from about $75\times10^6$ to $425\times10^6$ W/cm$^2$.

An especially preferred laser for use in imaging the lithographic printing member of this invention is an Nd:YAG laser that is Q-switched and optically pumped with a krypton arc lamp. The wavelength of such a laser is 1.06 $\mu$m.

Imaging can be accomplished in two ways: "ablation" whereby exposed portions of the printing surface are loosed, removed or vaporized, and "melting" whereby the zirconia in the exposed portions of the printing surface are melted and not ablated.

For use in the hydrophilic to oleophilic conversion process by means of ablation, the following parameters are characteristic of a laser system that is especially useful.

Laser Power: Continuous wave (average)—0.1 to 50 watts preferably from 0.5 to 30 watts Peak power (Q-switched)—6,000 to 100,000 watts preferably from 6,000 to 70,000 watts Power density—$30\times10^6$ W/cm$^2$ to $850\times10^6$ W/cm$^2$ preferably from $75\times10^6$ to $425\times10^6$ W/cm$^2$ Spot size in $TEM_{00}$ mode =100 $\mu$m, Current =15 to 24 amperes, preferably from 18 to 24 amperes, Laser Energy =$6\times10^{-4}$ to $5.5\times10^{-3}$ J, preferably_from $6\times10^{-4}$ to $3\times10^{-3}$ J, Energy Density =5 to 65 J/cm$^2$, preferably from 7 to 40 J/cm$^2$, Pulse rate =0.5 to 50 kHz, preferably from 1 to 30 kHz, Pulse width =50 to 300 nsec, preferably from 80 to 150 nsec Scan field =11.5×11.5 cm, Scan velocity =3 m/sec (maximum), and Repeatability in pulse to pulse jitter =~25% at high Q-switch rate (~30 kHz) <10% at low Q-switch rate (~1 kHz).

For imaging by means of "melting", essentially the laser set up conditions are basically the same as that of ablation conditions noted above, however whether the laser will operate in the ablation mode or in the melting mode will be determined by the dot frequency in a given scan area. It is also characterized by very low Q-switch rate (<1 kHz) slow writing speed (scan velocity of 30 to 1000 mm/sec) and wide pulse width (50 to 300 $\mu$sec).

The laser images can be easily erased from the zirconia alloy surface. The printing member is cleaned of ink in any suitable manner using known cleaning devices, and then the image is erased by either heating the surface in air or oxygen at an elevated temperature (temperatures of from about 150° to about 250° C. for a period of about 5 to about 60 minutes are generally suitable with a temperature of about 200° C. for a period of about 10 minutes being preferred) or by treating the surface with a $CO_2$ laser operating in accordance with the following parameters:

Wave length: 10600 mn

Peak Power: 300 watts (operated at 20% duty cycle)

Average Power: 70 watts

Beam Size: 500 $\mu$m with the beam width being pulse modulated.

In addition to its use as a means for erasing the image, a $CO_2$ laser can be employed as a means of carrying out the imagewise exposure in the process employing an oleophilic to hydrophilic conversion.

Only the printing surface of the zirconia alloy ceramic is altered in the image-forming process. However, the image formed is a permanent image which can only be removed by means such as the thermally-activated or laser-assisted oxidation described herein.

Upon completion of a printing run, the printing surface of the printing member can be cleaned of ink in any suitable manner and then the image can be erased and the plate can be imaged and used again. This sequence of steps can be repeated again and again as the printing member is extremely durable and long wearing.

In the examples provided below, the images were captured electronically with a digital flat bed scanner or a Kodak Photo CD. The captured images were converted to the appropriate dot density, in the range of from about 80 to about 250 dots/cm. These images were then reduced to two colors by dithering to half tones. A raster to vector conversion operation was then executed on the half-toned images. The converted vector files in the form of plot files were saved and were laser scanned onto the ceramic surface. The marking system accepts only vector coordinate instructions and these instructions are fed in the form of a plot file. The plot files are loaded directly into the scanner drive electronics. The electronically stored photographic images can be converted to a vector format using a number of commercially available software packages such as COREL DRIVE or ENVISION-IT by Envision Solutions Technology.

The invention is further illustrated by the following examples of its practice, which are not to be interpreted as limiting the invention in any way.

EXAMPLE 1

Several off-white colored 23-mm diameter X 2.5-mm thick zirconia-yttria ceramic disks were irradiated by a Nd:YAG laser so that the entire surface area turned black. The Nd:YAG laser was Q-switched and optically pumped with a krypton arc lamp. The spot size or beam diameter was approximately 100 $\mu$m in TEM (low order mode). The spot size can be increased to 300 $\mu$m in MM (multimode) using a 163-mm focusing lens. The beam diameter can also be made as small as 5 $\mu$m by using appropriate lenses.

The optical density of the black surface depended on the laser energy and the scan speed. Contact angle measurements were made by using a Rame-Hart contact angle goniometer. The two liquids used were double deionized water (polar) and methylene iodide (non-polar). The same measurements were made on zirconia/yttria ceramic surfaces that had not been exposed with the laser. Table 1 below summarizes the contact angle results and Table 2 summarizes the calculated surface energies. In Table 2, the total surface energy is broken down into the dispersive and polar components.

TABLE 1

| Sample | Laser Current/ Frequency | Laser Scan Speed, mm/s | Water (degrees) | Methylene Iodide (degrees) | Comments |
|---|---|---|---|---|---|
| 1 | None | — | 58.9 ± 4.2 | 39.6 ± 0.9 | White surface |
| 2 | 28 A/1 kHz | 104 | 77.9 ± 5.9 | 38.7 ± 1.0 | Black surface |

TABLE 2

| Sample | Dispersive (dynes/cm) | Polar (dynes/cm) | Total Surface (dynes/cm) |
|---|---|---|---|
| 1 | 31.0 | 16.7 | 47.7 |
| 2 | 36.1 | 5.0 | 41.1 |

The above results indicate that there is a substantial difference in contact angles (surface energy) between the laser treated and untreated areas such that water will selectively adhere to the untreated areas and an oil-based printing ink will selectively adhere to the treated areas.

EXAMPLE 2

Images containing half-tones through continuous tones were imprinted on 80 mm X 60 mm X 1 mm thick sintered zirconia/yttria ceramic printing plates. The plates were imaged using an Nd: YAG laser as described in Example 1. The imaged plate was cleaned with a fountain solution made up from Mitsubishi SLM-OD fountain concentrate. The concentrate was diluted with distilled water and isopropyl alcohol. Excess fluid was wiped away using a lint-free cotton pad. An oil-based black printing ink, Itek Mega Offset Ink, was applied to the plate by means of a hand roller. The ink selectively adhered to the imaged areas only. The image was transferred to plain paper by placing the paper over the plate and applying pressure to the paper.

The lithographic printing plates can be of any suitable size, shape or construction as long as the printing surface is comprised of a zirconia alloy ceramic. The zirconia alloy ceramic can be initially in a hydrophilic form or in an oleophilic form. The zirconia alloy ceramic printing plates serve as the key component of a lithographic printing system which includes, in addition to the printing plate, a laser that is capable of imaging the zirconia alloy ceramic surface, control means for operating the laser, a supply of fountain solution, means for applying the fountain solution to the printing surface, a supply of lithographic printing ink, and means for applying the lithographic printing ink to the printing surface. Optionally, but preferably, the lithographic printing system also includes means for erasing the image from the zirconia alloy ceramic surface.

Use of a zirconia alloy ceramic for lithographic printing, as disclosed herein, has many advantages over conventional lithographic printing techniques now in use. Thus, for example, the process to generate the lithographic printing plate is much faster than the conventional process because several steps are eliminated. The printing plate is very durable, having great wear-and abrasion-resistance, so that it can be used over and over again. The image is stable unless exposed to high heat, such as 200° C. heat, or high energy infrared radiation such as that from a $CO_2$ laser. The printing plate can be used more than once because the image is erasable. The printing plate can be conveniently generated on the press without having to install and dismantle for each printing application.

EXAMPLE 3

As discussed earlier, the rotary printing members of this invention can be prepared from highly dense zirconia alloy ceramics in any of the following forms: as a monolithic drum or printing cylinder, as a printing shell mounted on a metallic drum or core, or as a hollow printing sleeve. Each of these three forms were prepared using a zirconia-secondary oxide alloy, and specifically a zirconia-yttria alloy ceramic, using one of the following manufacturing processes:

a) dry pressing to the desired or near-desired shape, b) cold isostatic pressing and green machining, and c) injection molding and de-binding. After each of these processes, the member was then subjected to high temperature (about 1500° C.) sintering and final machining to the desired dimensions.

The shell and sleeve printing members were also prepared by slip casting of a zirconia alloy on a non-ceramic metallic core, and then sintering. The shell printing members were assembled on metallic core either by shrink fitting or press fitting.

These printing members were imaged as described above for the printing plates in Examples 1 and 2.

The invention has been described in detail, with particular reference to certain preferred embodiments thereof, but it should be understood that variations and modifications can be effected within the spirit and scope of the invention.

We claim:

1. A rotary lithographic printing member that can be imaged directly using a laser and is image erasable, said printing member having a printing surface composed of a non-porous zirconia ceramic that is an alloy of $ZrO_2$ and a secondary oxide selected from the group consisting of MgO, CaO, $Y_2O_3$, $Sc_2O_3$, a rare earth oxide, and a combination of any of these, said zirconia alloy ceramic having a density of from about 5.6 to about 6.2 g/cm$^3$, said rotary lithographic printing member having one of the following forms:

a) a printing cylinder composed entirely of said zirconia alloy ceramic, b) a non-ceramic core, and a hollow cylindrical sleeve or shell fitted around said core, said sleeve or shell providing said printing surface that is composed of said zirconia alloy ceramic, c) a hollow cylindrical sleeve composed entirely of said zirconia alloy ceramic, or d) a hollow cylindrical sleeve composed of an outer printing layer of said zirconia alloy ceramic.

2. The printing member of claim 1 comprised of said zirconia alloy ceramic in which the molar ratio of said secondary oxide to said zirconium oxide is from about 0.5:99.5 to about 25:75.

3. The printing member of claim 1 wherein said zirconia alloy ceramic is a zirconia-yttria ceramic.

4. The printing member of claim 3 wherein the molar ratio of the secondary oxide to zirconia is from about 0.5:99.5 to about 5.0:95.0.

5. The printing member of claim 1 wherein said zirconia alloy ceramic comprises the tetragonal crystalline form of zirconia.

6. The printing member of claim 1 wherein said zirconia alloy ceramic comprises a mixture of any two or more of the tetragonal, monoclinic and cubic crystalline forms of zirconia.

7. The printing member of claim 1 wherein said zirconia alloy ceramic is composed of a hydrophilic stoichiometric zirconia.

8. The printing member of claim 1 wherein said zirconia alloy ceramic is composed of an oleophilic substoichiometric zirconia.

9. The printing member of claim 1 wherein said zirconia alloy ceramic has an average grain size of from 0.1 to 0.6 $\mu$m.

10. The printing member of claim 1 wherein said zirconia alloy ceramic has a density of 6.03 to 6.06 grams/cm$^3$ and an average grain size of from 0.2 to 0.5 $\mu$m.

11. The printing member of claim 1 having a polished zirconia alloy ceramic printing surface.

12. The printing member of claim 1 wherein said non-ceramic core is composed of a ferrous metal, nickel, brass, copper, aluminum or magnesium.

13. The printing member of claim 1 having a porosity of less than 0.1%.

14. A rotary lithographic printing member having an imaged printing surface adapted for use in lithographic printing, said imaged printing surface comprising a non-porous zirconia ceramic having thereon an imagewise distribution of hydrophilic areas and oleophilic areas, said non-porous zirconia ceramic being an alloy of $ZrO_2$ and a secondary oxide selected from the group consisting of MgO, CaO, $Y_2O_3$, $Sc_2O_3$, a rare earth oxide, and a combination of any of these, said zirconia alloy ceramic having a density of from about 5.6 to about 6.2 g/cm$^3$, said rotary lithographic printing member having one of the following forms:

a) a printing cylinder composed entirely of said zirconia alloy ceramic, b) a non-ceramic core, and a hollow cylindrical sleeve or shell fitted around said core, said sleeve or shell providing said printing surface that is composed of said zirconia alloy ceramic, c) a hollow cylindrical sleeve composed entirely of said zirconia alloy ceramic, or d) a hollow cylindrical sleeve composed of an outer printing layer of said zirconia alloy ceramic.

15. A method of imaging comprising the steps of:

A) providing a rotary lithographic printing member that can be imaged directly using a laser and is image erasable, said printing member having a printing surface composed of a non-porous zirconia ceramic that is an alloy of $ZrO_2$ and a secondary oxide selected from the group consisting of MgO, CaO, $Y_2O_3$, $Sc_2O_3$, a rare earth oxide, and a combination of any of these, said zirconia alloy ceramic having a density of from about 5.6 to about 6.2 g/cm$^3$, and B) providing an image on said printing member by imagewise exposing said printing surface to laser irradiation that transforms said printing surface from a hydrophilic to an oleophilic state, or from an oleophilic to a hydrophilic state, creating a lithographic printing surface having both image areas and non-image areas, said rotary lithographic printing member having one of the following forms:

a) a printing cylinder composed entirely of said zirconia alloy ceramic, b) a non-ceramic core, and a hollow cylindrical sleeve or shell fitted around said core, said sleeve or shell providing said printing surface that is composed of said zirconia alloy ceramic, c) a hollow cylindrical sleeve composed entirely of said zirconia alloy ceramic, or d) a hollow cylindrical sleeve composed of an outer printing layer of said zirconia alloy ceramic.

16. A method of printing comprises the steps of:

A) providing a rotary lithographic printing member that can be imaged directly using a laser and is image erasable, said printing member having a printing surface composed of a non-porous zirconia ceramic that is an alloy of ZrO2 and a secondary oxide selected from the group consisting of MgO, CaO, $Y_2O_3$, $Sc_2O_3$, a rare earth oxide, and a combination of any of these, said zirconia alloy ceramic having a density of from about 5.6 to about 6.2 g/cm$^3$, B) providing an image on said printing member by imagewise exposing said printing surface to laser irradiation that transforms said printing surface from a hydrophilic to an oleophilic state, or from an oleophilic to a hydrophilic state, thereby creating a lithographic printing surface having both image areas and non-image areas, C) contacting said lithographic printing surface with an aqueous fountain solution and a lithographic printing ink, thereby forming an inked lithographic printing surface, and D) contacting said lithographic printing surface with a substrate to thereby transfer said printing ink to said substrate, forming an image thereon, said rotary lithographic printing member having one of the following forms:

a) a printing cylinder composed entirely of said zirconia alloy ceramic, b) a non-ceramic core, and a hollow cylindrical sleeve or shell fitted around said core, said sleeve or shell providing said printing surface that is composed of said zirconia alloy ceramic, c) a hollow cylindrical sleeve composed entirely of said zirconia alloy ceramic, or d) a hollow cylindrical sleeve composed of an outer printing layer of said zirconia alloy ceramic.

17. The method of claim 16 further comprising cleaning said inked lithographic printing surface, and erasing said image thereon.

* * * * *